US005772130A

United States Patent [19]

Toschi

[11] Patent Number: 5,772,130

[45] Date of Patent: Jun. 30, 1998

[54] METHOD AND MILL FOR CRUSHING RUBBLE

[75] Inventor: Angelo Toschi, Castellarano, Italy

[73] Assignee: Iperfin S.p.A., Modena, Italy

[21] Appl. No.: 793,811

[22] PCT Filed: Aug. 31, 1995

[86] PCT No.: PCT/IB95/00719

§ 371 Date: Mar. 5, 1997

§ 102(e) Date: Mar. 5, 1997

[87] PCT Pub. No.: WO96/07481

PCT Pub. Date: Mar. 14, 1996

[30] Foreign Application Priority Data

Sep. 6, 1994 [IT] Italy ..... RE94A0069

[51] Int. Cl.[6] ..... B02C 25/00

[52] U.S. Cl. ..... 241/30; 241/33; 241/186.35; 241/285.3

[58] Field of Search ..... 241/186.35, 33, 241/34, 36, 222, 186.2, 186.4, 186.5, 223, 224, 30, 285.3

[56] References Cited

U.S. PATENT DOCUMENTS

| | | | |
|---|---|---|---|
| 292,488 | 1/1884 | Hexamer | 241/33 |
| 2,941,731 | 6/1960 | Lykken et al. | 241/186.2 |
| 3,506,200 | 4/1970 | Raudenbush | 241/33 |
| 4,650,128 | 3/1987 | Goldhammer | 241/36 |

FOREIGN PATENT DOCUMENTS

| | | |
|---|---|---|
| 658440 | 4/1938 | Germany . |
| 2819611 | 11/1978 | Germany . |
| 1228705 | 3/1989 | Italy . |
| 437985 | 11/1967 | Switzerland . |
| 750535 | 6/1956 | United Kingdom . |

*Primary Examiner*—Mark Rosenbaum
*Attorney, Agent, or Firm*—Young & Thompson

[57] ABSTRACT

A method and a mill (1) or crushing station (A) for crushing rubble, wherein the crushed material fills the mill discharging hopper (9) for a height (H1) which is higher than the height (H) of a hopper discharging opening (11) so that a continuous material plug (6) is formed which closes said discharging opening (11). The discharging means (2; 17) can be either integrated into the mill discharging hopper (9) or form a separated discharging device (2) which is associated to the mill (1). In operation the plug (6) is continuously removed from the plug bottom and fed to the plug top so that said continuous plug prevents the formation and exhausting of dust. The known dust separation chambers are thus superfluous.

13 Claims, 5 Drawing Sheets

METHOD AND MILL FOR CRUSHING RUBBLE

BACKGROUND OF THE INVENTION

1. Field of the Invention

The present invention relates to a method and mill for crushing rubble.

For purposes of this application and the invention disclosed, the term "rubble" is used to refer to building demolition materials and similar materials which, during the crushing thereof, create a dust formation.

2. Related Art

A method and mill of the considered type are employed, for example, in plants for treating building demolition rubble for obtaining re-usable aggregate. A plant of this type is disclosed, for example, in IT-A-1,228,705 assigned to the applicant.

The crushing and discharging method of the known mills is illustrated below with reference to the schematic representation of FIG. 1.

The first stage of the plant of the type disclosed in IT-A-1,228,705 is formed by a crushing and discharging station, whereby said crushing and discharging station is illustrated in FIG. 1 and designated as a whole by A. Said crushing and discharging station A is formed by a mill 1, generally a hammer mill provided with hammers driven by a motor, and an underlying discharging device or box 2 for discharging the crushed material, for example on a conveyor belt 3. The discharging device 2 is a separated, distinct device which is removably associated to the mill 1.

In more detail, the mill 1 has at the top thereof a charging opening 4 into which the rubble to be crushed is introduced by means of a reciprocating feeder 5 or other suitable feeder. Inside the mill body 7 is supported a rotor 8 provided with the not shown crushing hammers, and that can be driven by a not shown electric or diesel motor, in the direction indicated by the arrow F. The lower portion of the mill body 7 forms a hopper 9 which is closed below by a bottom 10 and is open at one of the lateral sides thereof, in the shown example at the front side 12. The mill hopper 9 is housed in said discharging device or box 2. The latter is formed by a vibrating box which is made up of two sidewalls 13 and 14 and a back wall 15 fixed to the mill body 7 and a bottom 10 which is connected to a not shown vibrating means supported by springs on a basement in a not shown manner. The front side 12 of said discharging box 2 is open to allow the crushed material to be discharged in the direction of the arrow F.

The known crushing and discharging method comprises the following steps:

a) crushing the rubble charged into the mill, b) falling/hurling the crushed rubble into the underlying discharging hopper to form a material layer having a lower height (h) than the height (H) of the hopper discharging opening, and c) discharging the crushed material.

Sheet steel deflectors indicated at 18 guide the introduced material towards the central crushing chamber and towards the middle portion of the mill hopper.

The term "crushed material" is here intended to include all of the material passing through the mill, that is the effectively crushed material, the fine gravel and sand-like throughgoing fractions as well as the not crushable fractions like reinforcement iron rods, pieces of wooden and aluminum door and window frames, large pieces of paper cement sacks, pieces of plastic sheets and so on.

After this preliminary introduction of the known mills it is pointed out that in all the prior art mills the desired space between the level 19 of the crushed material level in the mill hopper 9 and the top side of said discharging opening 11 is always provided in order to ensure the free transit of said bulky pieces, particularly of the large wood and metal frame pieces as well as the iron rods, which latter present indeed the most different dimensions and entanglement shapes.

As to the pneumatic aspect of the known hammer mills it is pointed out that in operation the rotating hammers act like fan wheels and create a strong depression inside the mill crushing chamber. This depression sucks a large air quantity from outside through the charging opening 4 and discharges this air quantity, jet-like, into the mill hopper. The formed air/dust mixture is exhausted through the discharging opening 11 above the material layer 6, as illustrated by the chain of arrows in FIG. 1.

Inside the mill crushing chamber takes place severe crushing phenomena, as well as severe abrasion phenomena between the individual rubble parts with a consequent crumbling/chalking of the clayish and cementish components. Thus, the air jet stream leaving the mill includes a large quantity of dust. Furthermore, the air flow raises more dust when it impinges in the crushed material in mill hopper 9 and discharge box 2. These formations must be somehow separated or filtered away from the exhausted air/dust mixture in order to fulfil the anti-pollution specifications.

For carrying out the dust separation it is known to employ a large separation or filtering chamber which extends from the mill lower part towards the ground. A first solution uses sleeve filters that are very expensive to buy and service and that consume a great amount of energy. Another solution provides a strong water spraying above the dust formation area, and sometimes also on the rubble before the crushing thereof. This solution firstly requires water availability and secondly needs a great quantity of water. Further, it is noted that the water treatment can form contaminating percolations, which require an expensive treatment or disposal thereof.

A strong reduction of the needed water can be achieved by means of a dust separation chamber 21 (FIG. 1) which is defined by jute walls, is steadily wetted and is disclosed in the aforementioned IT-A-1,228,705. In dust separation chamber 21 are provided inner and outer water spraying nozzles 22. However, this solution requires water availability and involves, even if in a smaller and easily controllable measure, the danger of contaminating percolations.

The presence of water or moisture in the rubble, the crumbling/chalking of the clayish and cementish components tendency to set, the weight of the crushed material in the mill discharging hopper as well as in the discharging box and the discharging vibrations all cause a material compaction that creates a strong progressive agglomeration of the crushed material in the discharging box, starting from the sidewalls and the bottom toward the discharging box interior.

The agglomeration phenomenon leads to a progressive reduction of real discharging box capacity so that the quantity of the discharged material is reduced and the level of the crushed material in the mill hopper increases and causes in a short time the filling of the mill hopper as far as the mill interior. If the operator does not stop the mill, the mill filling will damage the mill internal components, the driving parts of the mill and the mill stop.

Operations for emptying the mill hopper and the underlying discharging box are carried out uncomfortably manually by a number of operators provided with picks, chisels, shovels and so on. The emptying operations are very time consuming and involve long and therefore expensive stop periods of the whole plant. Furthermore, it is pointed out that said kind of emptying operations are not occasionally but they occur several times a day.

GB-A-750 535 discloses improvements in controlling the feed of material to crushers allowing to switch over from a manually feeding of raw material to an automated one.

Feelers are provided which sense the height of the discharged material layer resting on a discharging conveyor and control the feed of raw material to the crusher. In this patent there is no suggestion to use a height variation of the discharged material layer to vary the rate of flow of the discharged material.

The shown crushing mills and stations could surely be used for crushing demolition rubble but they do not present any suggestions for avoiding dust exhaust.

CH-A-437 985 discloses a method and a mill for grinding cereals with a uniform granulometry without the use of screens.

The proposed solution is to provide a continuous material stream from the continuously feeding hopper 3 through the mill grinding chamber to the continuously discharging device 4 and to create a controllable stagnation of the material in the discharging hopper in order to vary the grinding time in the grinding chamber. This is achieved by bonding the discharging speed 4 to the grinding speed 5 by a common regulator 7. There is not any provision to sense the height of the discharging material for controlling the discharging speed.

The disclosed method can not be used for crushing demolition rubble. A continuous stream of rubble would clog and stop the mill in a very short time.

Also the mill disclosed in DE-C-658 440 is provided for grinding cereals without the use of screens. The material fed laterally by means of a screw feeder and enters directly into the grinding chamber onto the bottom thereof and directly against the mill hammers.

Like the document CH-A-437 985 also the DE-C-658 440 makes use of a continuous material stream, from the screw feeder housing 2' through the grinding chamber to a lateral discharging hopper 11. Inside the hopper is provided a flap valve 12 resting on the discharged material layer and acting simply as a closing member.

Also the mill disclosed in DE-C-658 440 can not be used for crushing rubble. The shown lateral hopper with its internal flap valve could not be used under the discharging opening of a rubble mill because the rubble parts hurled into the hopper would destroy the valve.

DE-OS 28 19 611 discloses a device mounted onto a mill for separating trash in a first stream of crushable material (leaving the mill through the bottom openings 8) and a second stream of crushable or not crushable scrap material (leaving the mill as a scrap plug through a lateral hopper 18). The hopper is separated from the crushing chamber by a flap valve 15 and may be provided with a second flap valve near the end thereof.

The scrap plug packed into the hopper 18 has two tasks to fulfil:

- to define an adjustable crushing time into the crushing chamber, and
- to hinder dust exhaust.

Due to the irregular shapes of the scrap parts it is obvious that the scrap plug will contain a plurality of interconnected hollow spaces which would not be capable of hindering a dust exhaust.

At any rate the dust formed in the crushing chamber can easily invade the environment through the mill bottom openings 8.

SUMMARY OF THE INVENTION

The main object of the present invention is to provide a method and a mill for crushing rubble of the kind pointed out in the introductory part and capable of avoiding the prior art drawbacks as well as allowing a continuous crushing and discharging of the crushed material without any dust formation.

It is another object of the present invention to avoid agglomerations in the discharge device that reduce the original or useful cross-section and volume provided for discharging the crushed material.

The present invention is based on the knowledge:

- that by varying the pneumatic mill behavior and abolishing the space between the crushed material level inside the mill hopper and the upper side of the discharging opening in the mill hopper
- whereby, as pointed out above, heretofore this space was deemed essential by those skilled in the art—it is possible to wholly avoid any dust formation and all the disadvantages is connected with said dust formation, and
- that, as corroborated by numerous repeated experiments, the wanted whole filling of the mill hopper with the crushed material in the form of a "continuous plug" does not hinder at all the bulky pieces discharged both from the mill and the mill hopper or discharging box during the progressive discharging of said continuous plug.

The substantial advantages achieved with the present invention consist in the fact that is obtained a crushing operation without dust formation. And this is achieved without additional ancillary means, but only utilizing the crushed material itself as a "continuous plug". Furthermore, the proposed method and mill or crushing station make the known dust separation means superfluous and allow a use of the improved crushing mill and station also in sites without water availability as well as in the neighborhood of built-up areas.

Another important advantage is to be seen in the fact that by means of extremely simple means, which have a reliable operation and are advantageously self-cleaning, is ensured a reliable crushed material discharging and wholly avoid the known agglomerations and t he consequent mill stops.

Still another advantage consists in the easy possibility to transform extant crushing mills in mills or crushing stations according to the present invention.

It is pointed out that with the method and a crushing mill according to the present invention it is possible to avoid whatever pollution and to substantially improve the working conditions for the sole operator who is now necessary.

Still another advantage is that by providing a variable height of the discharging opening by means of a self-positioning flap valve it is possible to place the detecting means in a clam environment outside the discharging devices, in which latter the crushed material hurled out from the hammer chamber could damage detecting means placed therein.

The present invention is further directed to a distinct discharging device per se as well as to the use of the improved mills and crushing stations in a plant for treating building demolition rubble and the like.

The present invention as well as further advantages and features thereof will now be described below in connection with several preferred embodiments illustrated in the drawings.

BRIEF DESCRIPTION OF THE DRAWINGS

In the drawings, the following are shown diagrammatically or in principle.

DETAILED DESCRIPTION OF THE PREFERRED EMBODIMENTS

Figure 1:
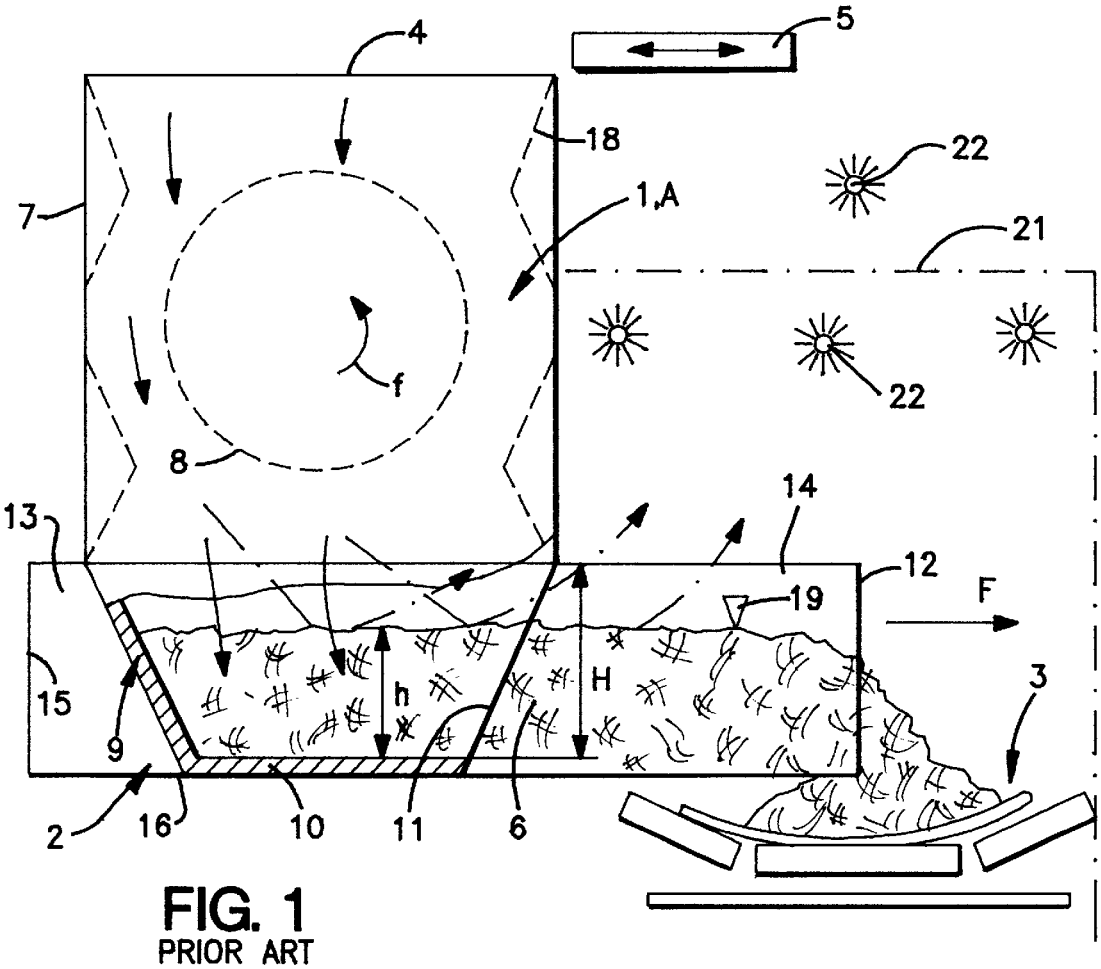
FIG. 1 PRIOR ART
FIG. 1 shows a side elevation view of a known crushing mill with associated discharging device for the crushed material, partly in cross-section.

The basic configurations of a known crushing mill 1 and a therewith associated discharging device 2 forming a rubble crushing station A for carrying out the known crushing and discharging method—operating with dust formation—are described in the introductory part with reference to FIG. 1.

The drawbacks and shortcomings of these known solutions have been likewise set forth in he introductory part.

Even if the mills or the crushing stations according to the present invention start from per se known units, the proposed improvements are such to lead—as it will be depicted hereinafter—to a rubble crushing and discharging method which is, like the obtained results, concept ally wholly different.

In the FIGS. 1 to 7 common equal or equivalent parts are generically designated by the sa e reference numerals as well as by specific reference numerals according to the different contemplated embodiments.

Particularly, as crushing unit 1, it is convenient to use a known hammer mill—due to its good efficiency, reliability and adjustment simplicity—.

However, this suggestion does not limit the type of the used mill. Among the different embodiments of employable discharging devices 2 it is certainly possible to further use the known vibrating discharging box because the latter, used according to the present invention, is not practically effected by the shortcomings of the known vibrating boxes as set forth in the introductory part.

According to the present invention the discharging device 2 associated to the mill 1 or the discharging means integrated, that is incorporated into the mill and illustrated hereinafter, should allow a so called "peeling-like" drawing or discharging of the crushed material from the bottom of the crushed material layer which now forms, in the hopper, a continuous column or "plug" 6. At t e outlet of the hopper, that is before the hopper discharging opening 11, the plug 6 has a height H1, as shown in FIG. 7, which is a little higher than the height H of discharging opening 11.

Figure 2:
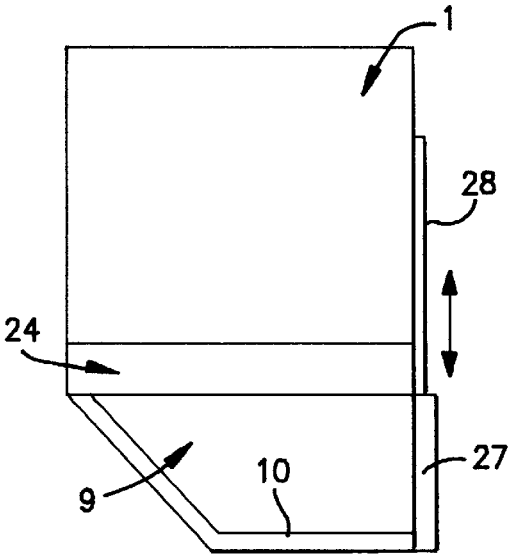
FIG. 2 shows a side elevational view of an improved mill according to the present invention with a discharging opening which can be closed to the present invention with a discharging opening which can be closed by a guillotine-like sluice gate, in the closed position.
Figure 2A:
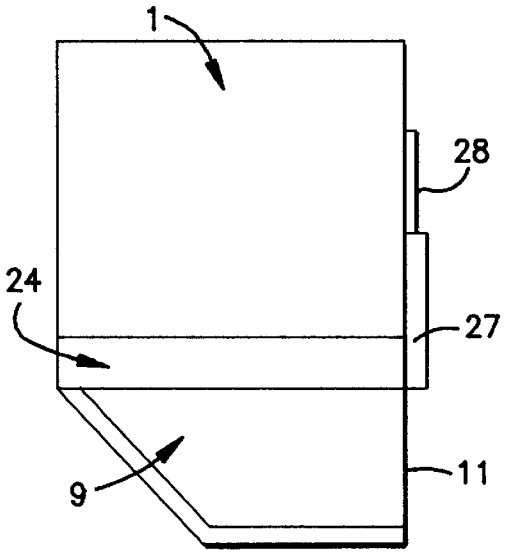
FIG. 2A shows a view similar to that of FIG. 2, however with the sluice gate in the open position.
Figure 7:
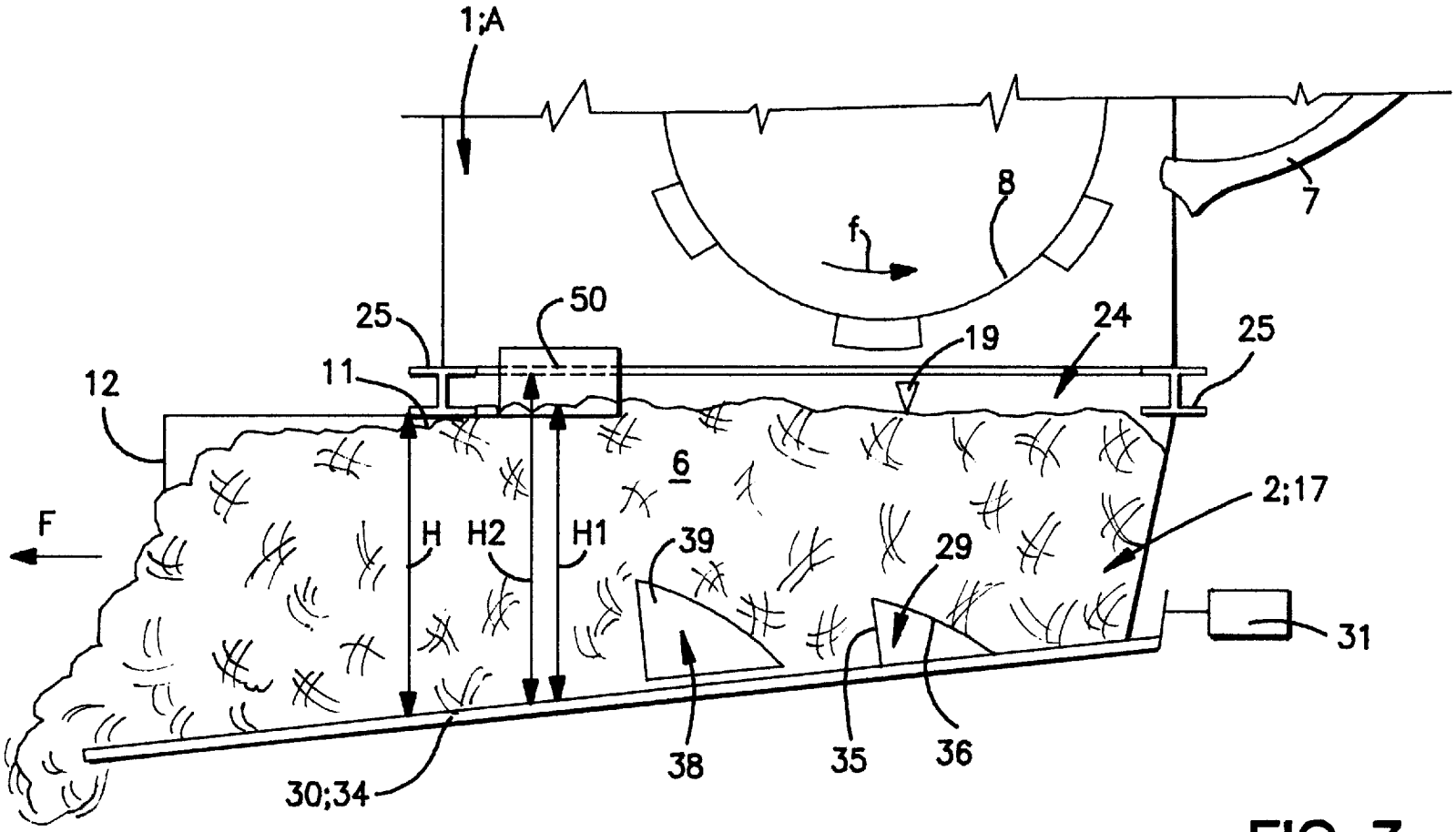
FIG. 7 shows an enlarged longitudinal cross-section taken along the discharging part of a mill according to the present invention, further provided with compulsory advancing means for the crushed material to be discharged, whereby said compulsory advancing means is provided on the movable bottom and the sidewalls of the hopper or the discharging device associated with the mill.

In the advantageous embodiments of FIG. 2, 2A and 7, above discharging opening 11, the mill body 7 is provided with a horizontal frame 24 having for example a rectangular shape and consisting of beams 25, in the shown embodiment of "I" beams.

The mill 1 is supported by a known and not illustrated supporting structure.

In an advantageous embodiment according to the present invention the open side or discharging opening 11 of the hopper 9 is provided with a sluice gate 27, in the shown embodiment a guillotine-like one, which is illustrated in its closed position in FIG. 2 and in its wholly opened position in FIG. 2A. Sluice gate 27 is for example movably mounted on guide element 28 and associated with driving means, for example a not illustrated rack-and-pinion drive or a likewise not illustrated cylinder-piston unit. FIG. 2 and 2A show a sluice gate 27 which is movable in a vertical plane. In practice, it is also obviously possible to place sluice gate 27 in an oblique position, as per se already known, FIG. 1, or in other positions as desired. Important is the fact that sluice gate 27 closes and opens the provided discharging opening 11. As to the discharging devices it is pointed out that they can be configured in accordance with the present invention either as distinct devices or means 2 which can be associated to the mill 1, for example to an extant mill, as in FIG. 4, 6, 7, or as discharging devices or means 17 which are integrated into the mill, as in FIG. 3, 5, 7. Therefore, the assembly formed by a mill with the relative discharging means integrated into the latter or associated to the mill, forms an improved mill or an improved crushing and discharging station A according to the present invention, respectively. The discharging and self-cleaning means 29 shown in FIG. 7 and described hereinafter car be provided both in the improved mills 1 and the crushing and discharging stations A according to the present invention.

Figure 3:
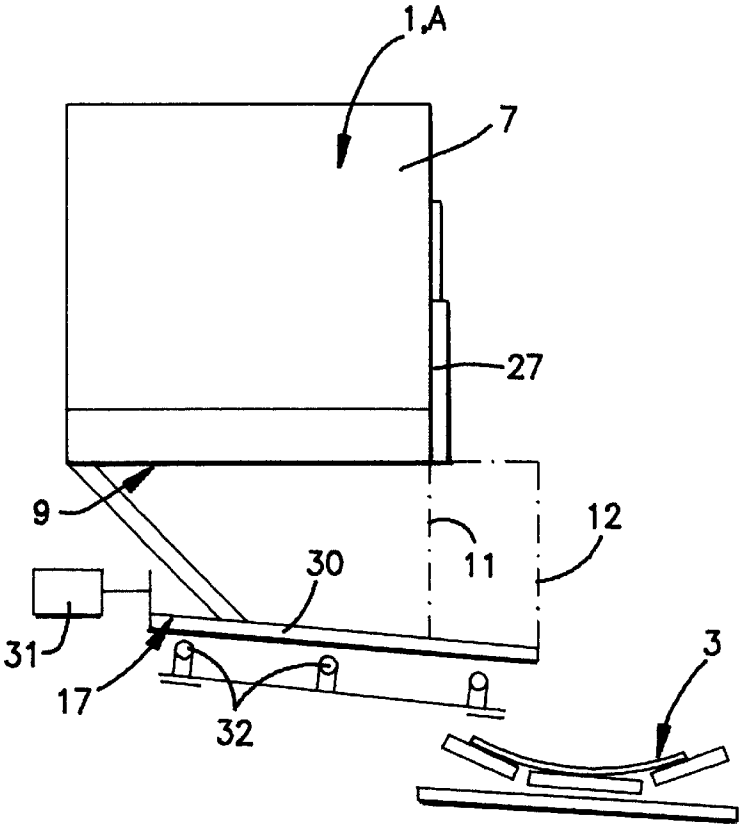
FIG. 3 shows a view similar to that of FIG. 2, however with discharging means integrated into the mill and formed by a hopper bottom configured as a vibrating or reciprocating movable bottom.

Reference is now made to FIG. 3. The shown mill 1, which may have either a common discharging opening 11, that is an opening 11 which is always open, or an opening provided with a sluice gate 27, is provided with a discharging means 17 which is integrated into the structure of th mill hopper 9. In more detail, the bottom 10, per which see FIG. 1, of mill hopper 9 is constructed as a movable bottom, for e as a carriage-like bottom 30 which is connected to a driving means 31 such as reciprocating drives or vibrating drives, as per se known in feeding boxes for incoherent materials. Advantageously, driving means 31 is preferably configured as an adjustable one.

The mechanical coupling between the movable bottom 30 and mill discharging hopper 9 can be accomplished in whatever suitable manner, for example by means of not shown sliding guides.

In the case of reciprocating (rives, good results have been obtained using eccentric crank gears associated with a geared motor with an adjustable speed as well as with drives formed by hydraulic piston-cylinder units, whereby the piston rods are fixed to carriage-like bottom 30. Preferably, between the hopper 9 and the fixed cylinders of the piston-cylinder units are interposed cushioning spring. The known drives are not illustrated in detail. Other operatively equivalent drives can also be substituted. With the usual sizes of the known hammer mills and discharging hoppers thereof, good results have been achieved with reciprocating strokes of the movable bottom in the range of 3 to 15 cm, preferably in the range of 5 to 10 cm, and most preferably with strokes amounting to 8 cm. Of course, stokes having other stroke values may also be used, and this as a function of the material to he treated.

In the case of vibrating drives the preferred adjustments can concern the revolving speed of the eccentric and/or the degree of eccentricity.

The carriage-like bottom 3 can be horizontal or, preferably, it can be slanting downwards and towards the discharging direction, as illustrated in FIG. 3. The carriage-like bottom 30 is advantageously supported on supporting rollers 32. Between the carriage-like bottom 0 and the fixed walls of mill hopper 9 are advantageously provided not shown gasket elements, for example bellows-like gaskets or longitudinal lip seals forming chambers.

In order to obtain a more stable formation of the continuous plug 6 the sidewalls of mill hopper 9 can longitudinally project outside the mill body 7, as shown in FIG. 3 with chain-dotted lines.

Figure 4:
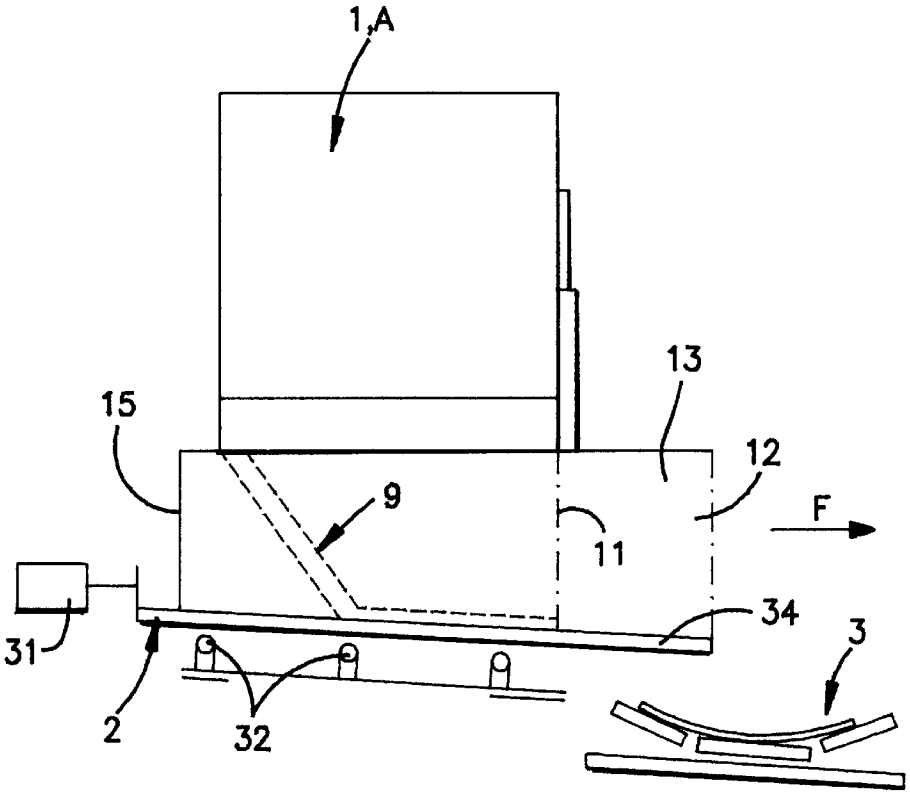
FIG. 4 shows a view similar to that of FIG. 2, however with a distinct box-like discharging device provided with a vibrating or reciprocating movable bottom.

In the embodiment of FIG. 4 to the mill hopper 9 is associated a discharging box 2 having a movable carriage-like bottom 34 provided with a respective driving means 31, for example as described with regard to FIG. 3. Like the known vibrating box 2, FIG. 1, also the carriage-like box shown in FIG. 4 houses the discharging hopper of the mill 1, thereby forming a crushing and discharging station A.

References is now made to FIG. 7. For achieving a reliable material advance as well as a self-cleaning action of the hopper (FIG. 3) or of the discharging box 2 (FIG. 4) having both a carriage-like bottom 30 or 34, on bottom 30 or 34 transversely to the discharging direction, arrow F, is fixed, for example welded, at least one push beam 35. Both for construction stiffening purposes as well as for achieving a back stroke of the movable bottom excluding material compacting action, the push beam 35 is provide with a back roof-like covering 36. The beam 35 and the covering 36 define a wedge-like structure forming said self-cleaning means 29. Upstream to the push beam 35 and parallel to the latter is provided a wedge-like 38 which is fixed, for example welded, to the sidewalls of the hopper 9 (FIG. 3) or of the discharging box 2 having said carriage-like bottom 34 (FIG. 4 and 7), whereby the slanting or bent back side 39 of the wedge structure 38 faces the push beam 35. Lastly, in FIG. 7 the reference numeral 50 denotes an observation window by means of which during experimental operations it was possible to observe the behavior of the material inside the mill hopper 9 or the discharging box 2.

In the embodiment shown in FIG. 5 is provided again a discharging means 17 which is integrated into the mill hopper 9 and which is constructed as an endless belt 41 forming the movable bottom 42 of the discharging hopper 9. The belt 41 is mounted on two wheels 43 and 44, whereby the wheel 44 is a driving wheel and it is connected to a driving geared motor 45 with associated not shown speed variator. The upper belt section 46 of belt 41 slides on a substantially continuous supporting plane or platform 47 which is formed for example as a supporting metal plate or as a number of boards which are disposed parallel to each other in the longitudinal direction, or as transversely disposed not shown rollers and so on. The purpose of these measures is to prevent the belt from damage due to the strong impingement on the belt of the crushed material as well as the reinforcement iron rods and so on during the starting phase, that is when the belt is not yet covered by the crushed material. During the normal operation belt 41 is covered by the crushed material plug, which avoids this danger.

Like the carriage-like bottoms 30 and 34 also the structure of the bottom configured as an endless belt 41 is supported on a not shown basement which can be realized in any suitable manner.

In a preferred embodiment, the discharging belt 41 is configured as a belt track which is produced in metal or plastics, for example in plastics incorporating a metal core and/or reinforcement fibers.

Figure 6:
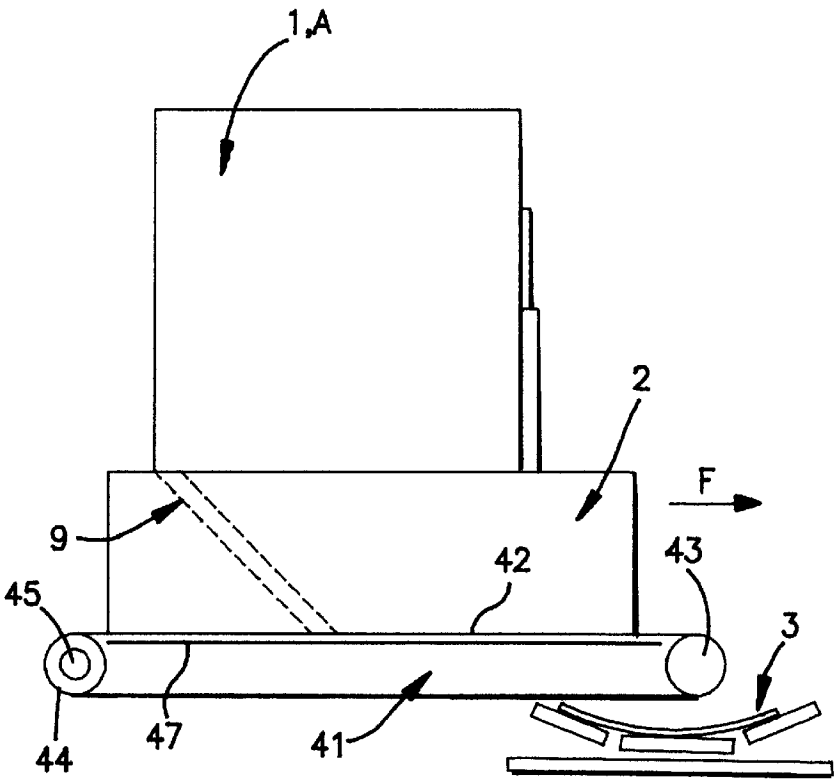
FIG. 6 shows a view similar to that of FIG. 2, however with a distinct box-like discharging device provided with an endless belt-like movable bottom.
Figure 5:
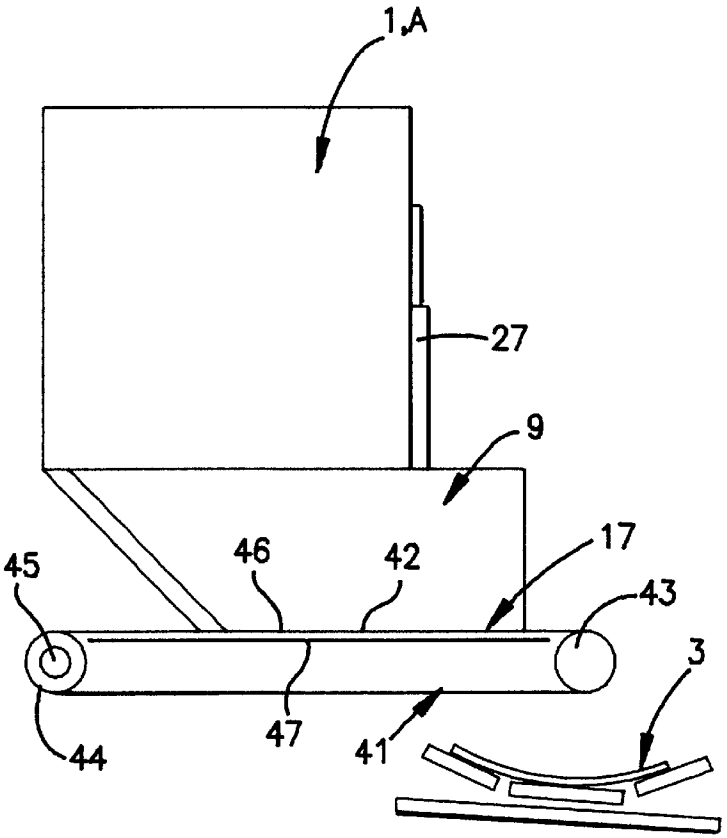
FIG. 5 shows a view similar to that of FIG. 2, however with a discharging means integrated into the mill and formed by the hopper bottom configured as an endless belt.

In the embodiment illustrated in FIG. 6 with the mill 1 is associated a box-like discharging device 2 having a movable bottom 42 in the form of an endless belt 41, as illustrated in FIG. 5, so that a crushing and discharging station A according to the present invention is formed.

Figure 8:
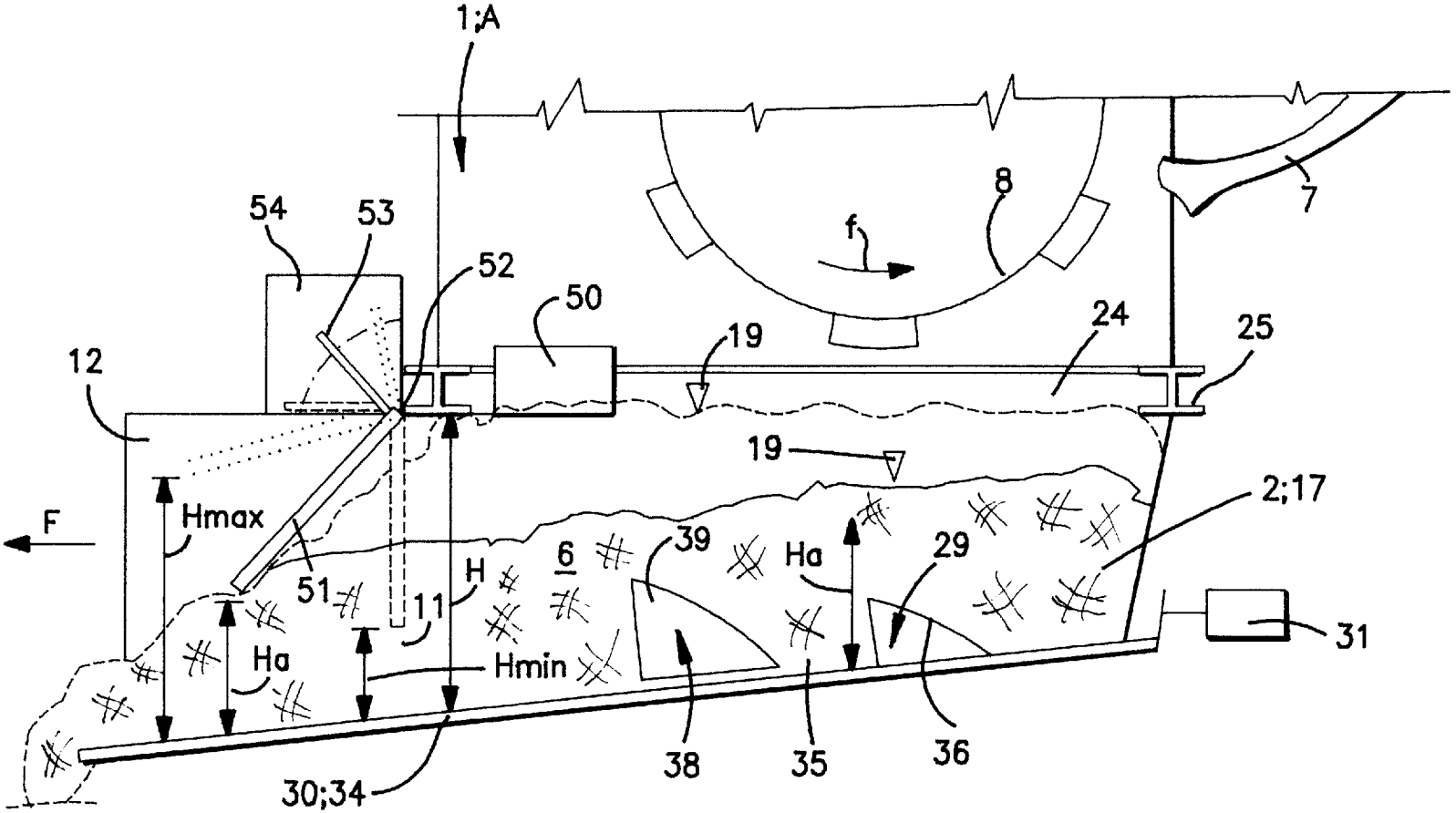
FIG. 8 shows a preferred embodiment provided with a means allowing variations of the height of the discharging opening during operation.

Reference is now made to FIG. 8. It can be seen that the upper part of the discharging opening 11 is provided with a flap valve 51 the axle 52 of which is pivotally supported in a dust tight manner at the top of the discharging opening 11, transversely to the discharging direction F.

Due to its own weight, and/or by means of not shown spring preloading means, flap valve 51 tends to take a vertical position, shown with dashed lines, so that when the mill hopper 9 or discharging means 2; 17 are empty, the height of the discharging opening 11 becomes Hmin.

In use, the flow of the crushed material being discharged pushes the flap valve 51, in the sense of opening the latter, so that the actual height value Ha of the discharging opening 11 increases, and more specifically it could increase up to the maximal height value Hmax., shown with dotted lines.

The reference numeral 53 denotes an arm which is fixed to the flap valve axle 52, or, not shown, to the outer surface of the flap valve 51 itself, and is operatively connected to a per se known electric, pneumatic, hydraulic or mechanic detecting means generally denoted by 54.

A mechanical coupling could be realized, in a not shown manner, for example by means of an arc-like rack, the pinion of which is engaged with the detecting means 54, the output of which is connected to the means 31 controlling the rate of the discharging material flow. Detecting and adjusting/controlling means 51 per se as well as the connection circuits thereof with each other and, preferably, with the mill superior control computer or processor are known by those skilled in the control technique and, therefore, not shown.

The operation of the improved mill or crushing and discharging station according to the present invention is as follows.

Reference is made to FIG. 2 to 7. During the short starting phase the crushed material as well as the components which cannot be crushed are hurled out from the mill into the underlying hopper. In a short time the material coming from the mill will wholly fill the mill hopper and when the material level 19 surpasses the height H and, reaching a height H1, begins to enter into the frame 24, in the hopper there will be a material column or "plug" 6, which closes the discharging opening 11 and so prevents an air, and consequently a dust, exhaust or emission from discharging opening 11. This behavior is obtained in all the illustrated embodiments of improved mills, discharging means 17 integrated into the mill 1, and crushing and discharging stations A.

Under such conditions it will be sufficient to adjust the balance state between the plug level and the rate of material flow discharged by the mill hopper 9 incorporating the discharging means 17 (FIGS. 3, 5, 7), by the carriage-like discharging box 2 (FIGS. 4, 7) or by the discharging box 2 having an endless belt bottom (FIG. 6). This balance state can be controlled and maintained manually or adjusted in an automatic manner by controlling, singularly or in combination, the frequency and the length of the reciprocating strokes of the carriage-like bottoms, or the speed and the degree of eccentricity of the vibrating bottoms, or the speed of the discharging belt-like bottom. At any rate, the necessary circuits and the components thereof are well known to those skilled in the control and regulation technique, so that these circuits and components are not described and shown in detail.

According to the present invention during operation the formation of the material plug 6 is kept up continuously, whereby the plug height H1 can vary for example within the range of the height of the frame 24, that is between H and H2. Under such conditions the discharging opening 11 is always maintained "plugged up" in a so to say "fluidic" manner so that during the mill operation the formation of dust is always prevented, and this both from the mill and from the hopper 9 thereof as well as from the distinct discharging device 2. In fact, the mixture consisting of crushed parts having different sizes and the fine gravel and sand-like fractions forming the plug 6 renders plug 6 at the same time very packed and notwithstanding supple so that the plug 6 has a "sealing behavior" with regard to the discharging opening 11.

During operation the material plug 6 is formed continuously again, whereby the plug part which is peeled up from the plug bottom is continuously replaced by a corresponding plug top feed from the mill charging opening 4 such that the height H1 of the plug 6, for example inside the frame 24, is maintained continuously.

The push beam 35 during its pushing movement towards fixed wedge 38 causes a compulsory snowplow-like advance of the material inside the discharging hopper or box so that the pushed material slides upon the wedge 38 and can be reliably discharged. The beam 35 during its back stroke creates between itself and the wedge 38 a void, into which falls the abovelying plug material.

These operation cycles ensure both a reliable discharging and transfer of the plug material, for example on a conveyor belt 3 or the like, as well as an efficient self-cleaning action of the hopper 9 or the carriage-like box 2. In this manner it is possible to reliably avoid the known clogging agglomeration of the known vibrating discharging boxes.

In the case of a belt-like movable bottom 42 the latter may also be provided on its upper surface with not shown transversely arranged section bars in order to facilitate the peeling, drawing or discharging of the plug material. These section bars act with the ends thereof as scrapers with regard to the sidewalls of the hopper or the discharging box with a belt-like movable bottom so that section bar ends also exert a self-cleaning or anticlogging action.

Due to the fact that the material drawing or discharging action from the plug bottom occurs in an efficient manner and the continuous plug 6 has a rather friable and "fluidic" consistency, it is stressed that in practice the not crushable pieces like reinforcement rods, joists, pieces of cement paper sacks, window and door frame pieces and the like, contrary to all expectations, gradually sink into the continuous plug, uniformly advance and are discharged without any problems—regardless the shapes or entanglements thereof—from the discharging opening 11.

Furthermore, it is pointed out that in mills having traditional discharging hoppers or boxes during the first starting phase the formation of the crushed material layer into the empty hopper 9 or discharging box 2 is accompanied—up to the completion of the material plug 6—by a dust formation. In practice this drawback can be avoided by preliminarily filling—through the stopped mill—the underlying hopper 9 or discharging box 2 with gravel and/or sand, in this case screened sand. Moreover, this shortcoming can also be simply avoided by providing a discharging opening 11 provided with a sluice gate 27. In this case the discharging opening 11 will be kept closed during the starting phase till the completion of the material plug 6 and then said opening 11 will be opened to allow the crushed material discharging step as depicted above.

The alternate embodiments and operation of the mill 1 or crushing station A shown in FIG. 8 correspond in principle to those depicted in FIG. 7 and set forth the description directed to the FIG. 2 to 7.

The only difference relates the height H of the discharging opening 11, whereby in the embodiments of FIG. 2 to 7 the actual height value H is a predetermined fixed height H, whereas in the embodiment of FIG. 8 the height of the discharging opening 11 is a variable height, the actual value Ha of which can range between a minimum height Hmin. and a maximum height Hmax. This range can be freely chosen. In operation the height Ha is always determined by the pushing action of the plug material inside the hopper 9 or discharging devices 2; 17, whereby the plug material continuously engages the flap valve 51 so that the plug level 19 inside the hopper is always higher than the actual discharging height Ha. Under such circumstances the plug 6 can always develop its "clogging" action with regard to the discharging opening 11 avoiding the dust formation and exhaust according to the teaching of the present invention. It is pointed out that employing a discharging opening have a variable discharging height Ha, the plug level 19 can of course drop below the beam frame 24.

The solution illustrated in FIG. 9 facilitates, on one hand, the adjustment of the means 31 regulating the rate of the material or plug being discharged, because of the great possible variation range Hmin.—Hmax. and the corresponding longer adjusting or controlling time at disposal, and allows, on the other hand, an arrangement of the means 54, detecting the plug level 19 inside the mill, in a position outside the mill. In fact, the detecting means 54 detects the actual height Ha of the discharging opening 11 and consequently, indirectly and roughly, the plug level 19, which is always higher than the measured actual height Ha.

The different steps of the crushing and discharging method according to the present invention are inferable from the above structural and functional description of the improved mill 1 (FIGS. 2, 2A), the mill 1, A into which is integrated the incorporated discharging device 17 (FIGS. 3, 5, 7 and 8) as well as the crushing and discharging stations A (FIGS. 4 and 6).

In practice both the above described mill 1 and distinct discharging means 17 could be replaced by any other suitable device which is capable of carrying out the proposed method.

It resides expressly within the scope of the present invention to manufacture the distinct discharging means 2 to be associated to a mill 1 as well as the discharging means 17 to be integrated into the mill 1, as separately, that is individually per se manufactured and marketable devices, which can then be mounted on an extant mill for transforming the latter in an improved mill or crushing station operating according to the teaching of the present invention, that is without dust formation or blowing off.

I claim:

1. Method for crushing rubble in a mill or station for crushing and discharging rubble comprising the steps of:

a) feeding an adjustable rate of the rubble flow to be crushed, b) crushing the rubble charged into the mill, c) falling/hurling the crushed rubble into an underlying discharging hopper to form a material plug, d) discharging the crushed rubble from a bottom of the material plug, e) sensing a height (h) of the material plug for adjusting purposes, and f) adjusting a rate of discharging the crushed rubble as a function of the sensed height of the material plug such that the height (level 19) of the plug is kept between a minimum height (H1) which is higher than a height (H) of the hopper discharging opening and a maximum height (H2) which corresponds substantially to a level of a discharging opening of the mill, so that a top of the plug acts as an obturator between the mill discharging opening and the hopper discharging opening.

2. The method according to claim 1, wherein the mill or crushing station is provided with a flap valve hinged at the upper edge of the hopper discharging opening, and wherein the step of sensing the plug height (level 19) inside the discharging hopper is accomplished indirectly by detecting means arranged outside the discharging hopper, coupled with said flap valve, and operatively connected to driving means controlling the rate of the discharging flow.

3. The method according to claim 1, wherein the material discharging step takes place with a discontinuous or continuous material removal from the bottom of said plug.

4. Mill for crushing of rubble comprising:

adjustable rubble feeding means (5), a top opening (4) for charging the rubble, crushing means (8) for crushing the charged rubble, an underlying discharging hopper (9) for receiving the crushed rubble, said discharging hopper comprising a bottom (10) receiving the crushed rubble and a lateral crushed rubble discharging opening (11), and wherein the crushed rubble forms on the hopper bottom (10) a rubble plug (6), discharging means (2, 17) for discharging the rubble plug, provided with driving means associated therewith, means for sensing the height (h) of the discharged rubble plug, wherein, the top edge of the hopper discharging opening (11) is provided lower than a level of a discharging opening from the mill, and said means for sensing the height of the rubble plug are operatively connected to said driving means (31, 45) controlling said discharging means (2, 17) such that in operation the rubble plug (6) height (level 19) is kept between a minimum height (H1) which is higher than the top edge of the hopper discharging opening and a maximum height (H2) which corresponds substantially to the level of the mill discharging opening so that a top of the plug acts as an obturator between the mill discharging opening and the hopper discharging opening.

5. The mill according to claim 4, wherein the hopper discharging opening (11) is provided with a flap valve (51) which is pivotally supported on a hinge, dust tightly and transversely to a discharging direction (F) of the crushed rubble, and wherein said flap valve (51) tends to take a vertical position, and in operation the material being discharged pushes continuously against said flap valve (51), wherein, in operation a lower edge of said valve acts as a movable upper edge of the hopper discharging opening (11), and detects an actual value (Ha) of the discharged rubble plug and, indirectly, the plug height (level 19) inside the hopper (9), and the means for sensing the plug height (level 19) is coupled with the hinge (52) of said flap valve (51) with an arm (53) thereof fixed to said valve hinge (52) and is operatively connected through a mill computer, to said driving means (31, 45) controlling said discharging means (2, 17).

6. The mill according to claim 4, wherein said discharging means (17) is formed by the bottom (10) of said hopper (9), said bottom being constructed as a movable bottom (30) provided with associated driving means (31).

7. The mill according to claim 6, wherein the movable bottom (30) of said hopper (9) comprises at least one material push beam (35) and a wedge (38).

8. The mill according to claim 4, wherein, said discharging means (2) are formed by a movable bottom (34) of a distinct box-like discharging device (2), said box-like discharging device (2) houses said mill hopper (9), and said box-like discharging device (2) is provided with associated driving means (31) and sidewalls (13, 14) and a back wall (15) which are fixed and connected to a mill body (7), whereby an open one of said walls of said discharging device faces said hopper discharging opening (11).

9. The mill according to claim 8, wherein, said movable bottom (30; 34) is configured as a reciprocating carriage-like bottom, said carriage-like bottom (30; 34) is supported by means for absorbing the impact impinging action of the rubble hurled out of the mill (1), said carriage-like bottom (30; 34) extends sloping towards the open wall, and said driving means (31) comprises reciprocating stroke drives or vibrating drives.

10. The mill according to claim 9, wherein reciprocating strokes of said carriage-like bottom (30; 34) are in the range of 3 to 15 cm.

11. The mill according to claim 8, wherein, said movable bottom (42) is constructed as an endless belt (41), a belt section (46) facing the hopper (9) or the discharging box (2) slides on a substantially continuous supporting platform (47), and said driving means comprises an electric geared motor (45) with adjustable speed.

12. The mill according to claim 11, wherein the endless belt (41) is configured as a tracked belt.

13. The mill according to claim 4, wherein a perimetral mill body portion between the mill discharging opening and an upper edge of said discharging hopper (9) comprises a frame (24) consisting of beams (25), and the plug top lies inside the height of said beam frame (24).

* * * * *